US007938484B2

(12) United States Patent
Leng

(10) Patent No.: US 7,938,484 B2
(45) Date of Patent: May 10, 2011

(54) FOLDABLE CHAIR

(75) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 72 days.

(21) Appl. No.: 12/414,837

(22) Filed: Mar. 31, 2009

(65) Prior Publication Data

US 2009/0261628 A1 Oct. 22, 2009

(30) Foreign Application Priority Data

Apr. 16, 2008 (CN) ..... 2008 2 0102001 U

(51) Int. Cl.

| | |
|---|---|
| ***A47C 4/00*** | (2006.01) |
| ***A47C 4/04*** | (2006.01) |
| ***A47C 4/10*** | (2006.01) |
| ***A47C 4/14*** | (2006.01) |
| ***A47C 4/20*** | (2006.01) |
| ***A47C 4/24*** | (2006.01) |

(52) U.S. Cl. ..... 297/57; 297/23; 297/46; 297/55; 297/56

(58) Field of Classification Search ..... 297/46, 297/47, 55, 56, 57, 23, 24, 25, 26
See application file for complete search history.

(56) References Cited

U.S. PATENT DOCUMENTS

| | | | | | |
|---|---|---|---|---|---|
| 88,513 | A | * | 3/1869 | Rodgers | 297/57 |
| 105,253 | A | * | 7/1870 | Rodgers | 297/57 |
| 274,730 | A | * | 3/1883 | Decker | 297/57 |
| 332,342 | A | * | 12/1885 | Horn et al. | 297/57 |
| 431,338 | A | * | 7/1890 | De Kalb | 297/57 |
| 479,355 | A | * | 7/1892 | Eldridge | 297/57 |
| 1,800,107 | A | * | 4/1931 | Schmitt | 297/57 |
| 1,949,492 | A | * | 3/1934 | Schermerhorn | 297/57 |
| 2,002,118 | A | * | 5/1935 | Johnson | 297/57 |
| 2,272,307 | A | * | 2/1942 | Merrill | 297/57 |
| 2,552,883 | A | * | 5/1951 | Cable | 297/57 |
| 2,649,140 | A | * | 8/1953 | Housel | 248/431 |
| 2,650,653 | A | * | 9/1953 | Gethner | 297/57 |
| 2,873,793 | A | * | 2/1959 | Garcia | 297/57 |
| 3,266,839 | A | * | 8/1966 | Combs | 297/57 |
| 4,386,790 | A | * | 6/1983 | Kassai | 280/650 |
| 4,415,201 | A | * | 11/1983 | Wang | 297/57 |
| 5,577,799 | A | * | 11/1996 | St. Germain | 297/55 X |
| 5,597,101 | A | * | 1/1997 | Barber et al. | 297/57 X |
| 5,855,409 | A | * | 1/1999 | Tseng | 297/46 X |
| 6,435,607 | B1 | * | 8/2002 | Liu | 297/55 |
| 6,709,050 | B2 | * | 3/2004 | Huang | 297/57 |
| 6,824,210 | B2 | * | 11/2004 | Zheng | 297/46 X |
| 6,953,221 | B1 | * | 10/2005 | Tseng et al. | 297/23 |
| 7,014,264 | B2 | * | 3/2006 | Alderman et al. | 297/55 X |
| 7,080,877 | B1 | * | 7/2006 | Tsai | 297/23 |
| 7,703,843 | B2 | * | 4/2010 | Chen et al. | 297/56 X |
| 7,717,502 | B2 | * | 5/2010 | Deng | 297/23 |
| 7,753,439 | B2 | * | 7/2010 | Akkad | 297/23 |
| 7,784,861 | B1 | * | 8/2010 | Deng | 297/23 |
| 7,857,379 | B2 | * | 12/2010 | Leng | 297/57 |

* cited by examiner

*Primary Examiner* — Rodney B. White
*Assistant Examiner* — Joseph Edell
(74) *Attorney, Agent, or Firm* — Rabin & Berdo, P.C.

(57) ABSTRACT

A foldable chair includes a pair of front legs, a pair of rear legs, a seat and a backrest. The front legs and rear legs are hinged together to form a scissor-shape. The seat is hinged with the rear legs rotatably through a connecting piece fixed on the back of the seat. Each of the front legs has a connecting sleeve which can be slid along the front leg. The connecting sleeves are hinged to the seat. A protrusion is disposed on each front leg to stop the connecting sleeve to slide downwardly and keep the seat on unfolded position. The seat of the foldable chair can slide upwardly along the front legs.

8 Claims, 5 Drawing Sheets

FOLDABLE CHAIR

FIELD OF THE INVENTION

The present invention generally relates to chairs and, more particularly, relates to a foldable chair.

BACKGROUND OF THE INVENTION

No matter at home, office or other places, chairs are one kind of indispensable furniture, which are usually utilized for relaxing in daily life. And foldable chairs, which have two states including being folded and unfold, are very popular with people. They can be folded to save space engaged when we do not need them. They are very and convenient to transport, and they are used widely. In most conventional foldable chairs, the seat and the front legs are hinged together, and the seat is connected with the rear legs slidably through a connecting device. As to be convenient to collect and transport, when the chair folded, the seat will be moved upwardly toward to the backrest, thus the front legs and the rear legs will abut against each other, and the chair will occupy less space. However, when some of the conventional chairs are folded to let the seat get close to the backrest, there will still be some angle between the seat and the backrest, and between the rear legs and front legs, the chair can not be folded enough. The thickness of the whole folded chairs is still too big, so they need to be further improved to decrease the occupied space.

Thus, we need a new kind of foldable chair to obviate the afore-mentioned problems and defects.

SUMMARY OF THE INVENTION

The primary object of the present invention is to provide a foldable chair with a seat which can slide upwardly, herein the seat is fixed slidably to the front legs and hinged to the rear legs. When the chair is folded, the seat can slide upwardly along the front legs, and the rear legs are close to the front legs, and the seat fold upwardly, thus the seat, front legs and rear leg can be close together completely to save the occupied space.

The object of the present invention is achieved by providing:

A foldable chair, includes a pair of front legs, a pair of rear legs, a seat and a backrest, wherein said front legs and said rear leg are hinged together rotatably to form a scissor-shape by riveting, said seat is hinged with the rear legs rotatably through a connecting piece fixed on the back of the seat, each of said front legs has a connecting sleeve which can be slid along the front leg, said connecting sleeves hinged to said seat by riveting, and a protrusion is disposed on each front leg to stop said connecting sleeve to slide downwardly and keep said seat on unfolded position.

Said backrest of the present invention mounted to one end of the front legs.

Said front legs and rear legs of the present invention cross with each other and formed a X-shape when the chair is in an unfolded position.

A "I"-shaped reinforcement frame disposed on the back of said seat of the present invention.

Said connecting sheet of the present invention is incorporated with said reinforcement frame.

Said connecting sleeve of the present invention includes a slide pipe and a connecting lock piece which can be hinged with the seat via rivet.

Said protrusion of the present invention is a pressure-resisting metal piece.

Said protrusion of the present invention connected to said front legs by welding, riveting, bonding or other equivalent, or incorporated with the said front legs.

There is a cross bar disposed between said rear legs of the present invention.

The shape of said seat of the present invention can be circular, square, rectangle or elliptic.

The present invention has the following advantages: the seat of the foldable chair can slide upwardly along the front legs through the connecting sleeve mounted on the front legs, the rear legs and the front legs can close together completely, and the seat also can close completely with the rear leg and front legs, thus the occupied space of the folded chair decreased. When the chair is in a unfolded position, without the limiting of the protrusion, the seat can be kept on an completely unfolded position stably. This invention has simple structure of and is easy to manufactured, and can also save the space engaged by the folded chair. The chair is convenient to be stored and transported and has many utilities.

BRIEF DESCRIPTION OF THE DRAWINGS

The specification, feature and effect of the present invention can be shown clearly in the detailed description of the preferred embodiments with the accompanying drawings.

In these figures.

Figure 1:
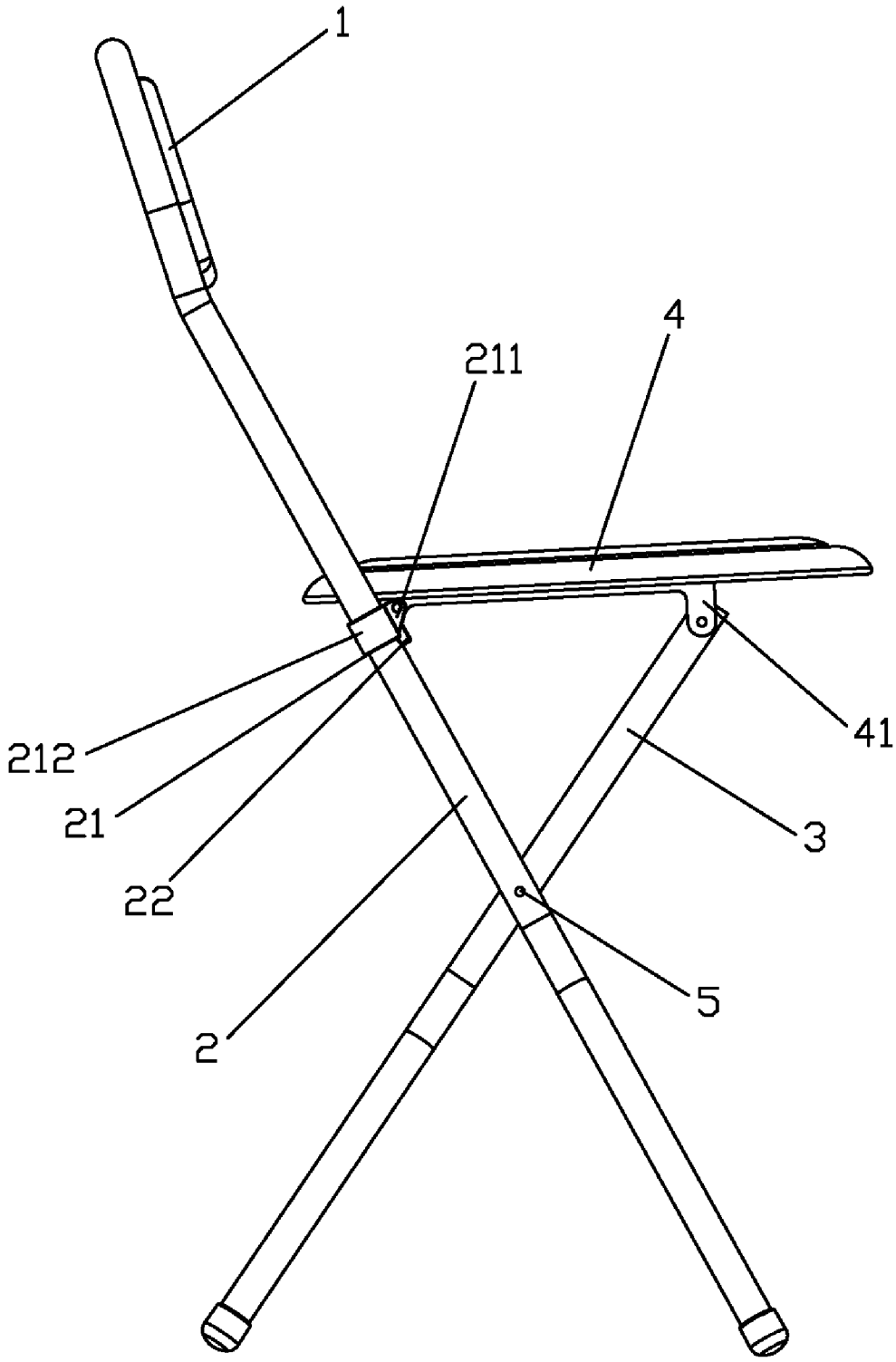
FIG. 1 is a side view of a foldable chair in an unfolded in-use position, according to the present invention.

1 backrest 2 front legs 21 connecting sleeve
212 slide pipe 211 connecting lock piece 22 protrusion
3 rear legs 31 cross bar 4 seat
41 connecting piece 421, 422 lengthwise reinforcement ribs
423 transverse reinforcement rib 5 rivet.

DESCRIPTION OF THE PREFERRED EMBODIMENTS

Figure 2:
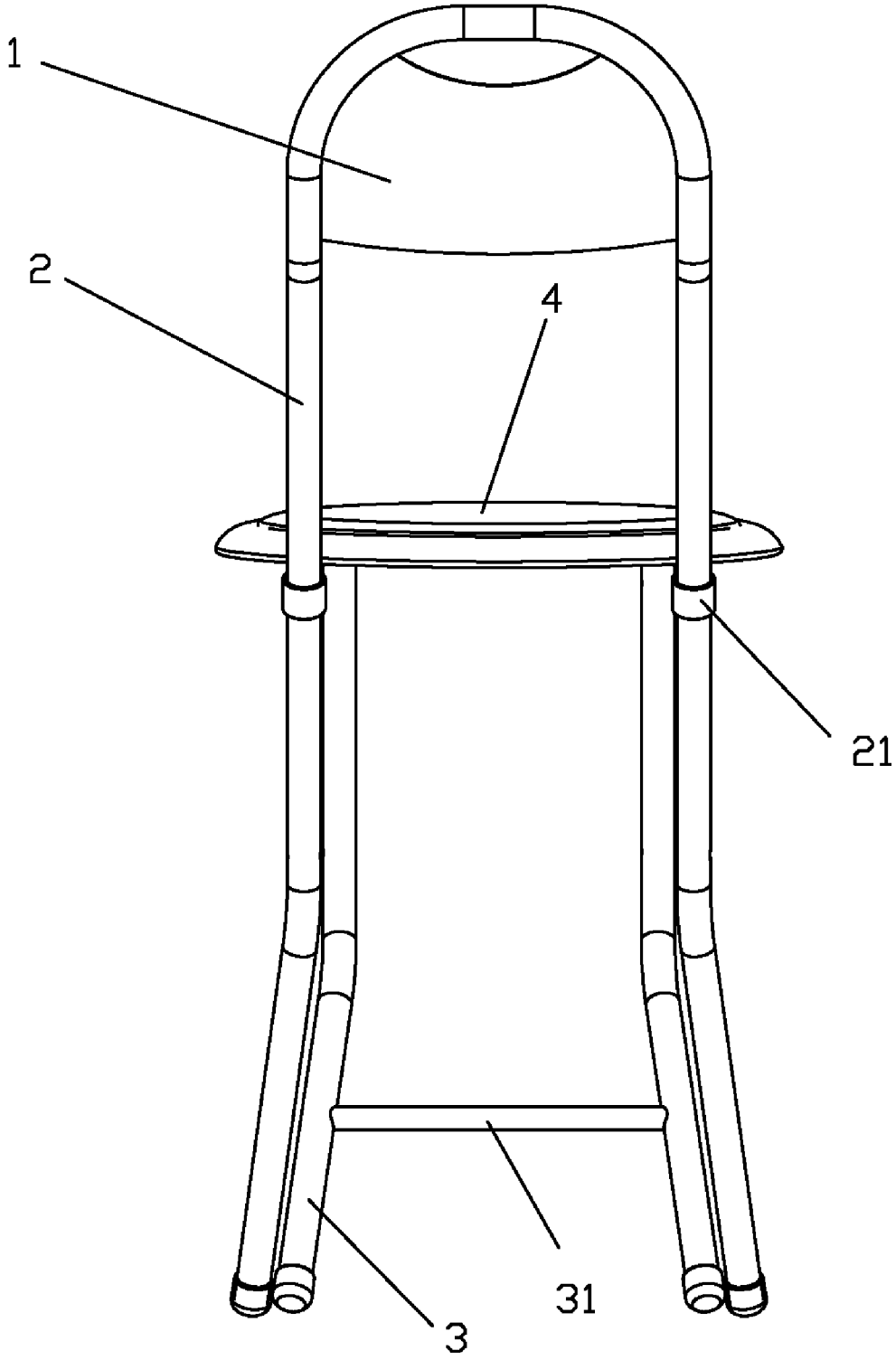
FIG. 2 is a back view of a foldable chair in an unfolded in-use position, according to the present invention.

In the following embodiment of the present invention, the foldable chair has a circular seat, without limitation. The seat with other shapes is also usable. FIG. 1 and FIG. 2 are a side view and back view when the chair is in an unfolded position. Referring to FIG. 1, a foldable chair includes: a backrest 1, a pair of front legs 2, a pair of rear leg 3 and a seat 4; backrest 1 is connected with one end of front leg 2; front legs 2 are hinged with rear legs 3 rotatably, and the front leg 2 and rear leg 3 can cross with each other at a certain angle, similar to a scissor. There is a slidable connecting sleeve 21 disposed on front legs 2 which can be slid along the front leg 2. The connecting sleeve 21 includes a tubular body (sliding pipe) 212, which can slide freely along front legs 2; a connecting lock piece 211 is hinged to the seat 4 by riveting, thus the connecting sleeve 21 can be hinged with the seat 4 via the connecting lock piece 211. The seat 4 is also hinged with the rear legs 3 by connecting piece 41 fixed on the bottom of seat 4. In this way, seat 4 can be slid along front legs 2 via connecting sleeve 21, and hinged with rear leg 3 by connecting piece 41, and make position changing with rear leg 3.

Moreover, to keep seat 4 at an unfolded position, a protrusion 22 is disposed on each front leg 2 to stop said connecting sleeve 21 from sliding downwardly and keep said seat 4 in an unfolded position. The protrusion 22 is mounted at a position where the chair is unfolded completely and seat 4 can be in a horizontal level. Because of the protrusion, connecting sleeve 21 cannot slide downwardly from the position where the protrusion 22 is set and can only slide upwardly along the front legs 21, such that seat 4 slides upwardly with connecting sleeve 21. At the same time, seat 4 and rear leg 3, hinged with each other by connecting piece 41, make displacement too. While seat 4 is sliding upwardly, the chair begins to fold and the angle between front leg 2 and rear leg 3 is changed. At last, front legs 2 and rear legs 3 close together completely, and the seat 4 also moves close to front legs 2 and rear legs 3 completely. Moreover, backrest 1 can be set on a line with front legs 2, or be at a certain angle with front legs 2. According to different requirements of different groups, we can choose the way how backrest 1 and front legs 2 are connected with each other. To add enough strength to seat 4, we can set an "I"-shaped reinforcement frame at the back of seat 4. This will be illustrated in the following.

Referring to the back view in FIG. 2, the backrest 1 is connected with front legs 2, and seat 4 is hinged with front legs 2 and rear leg 3 respectively; front legs 2 and rear leg 3 cross each other and form an X-shape; front legs 2 connect with seat 4 via connecting sleeve 21. A cross bar 31 is disposed between rear legs 3, which can make the foldable chair more balanceable and be used for people putting feet on it. FIG. 1 and FIG. 2 are a side view and back view when the chair is in an unfolded position. Detailed description of the process from unfolded position to folded position of the present invention will be described with reference to FIGS. 3 to 5.

Figure 3:
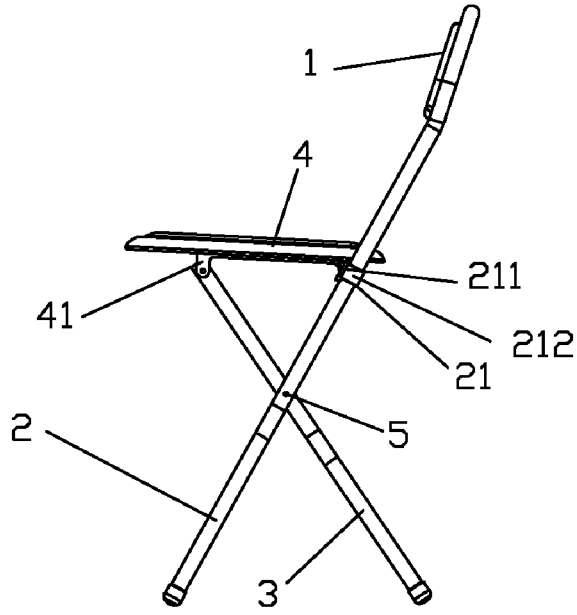
FIGS. 3, 4 and 5 are side views of a foldable chair in a position of unfolded, between folded and unfolded, and folded respectively, according to the present invention.
Figure 4:
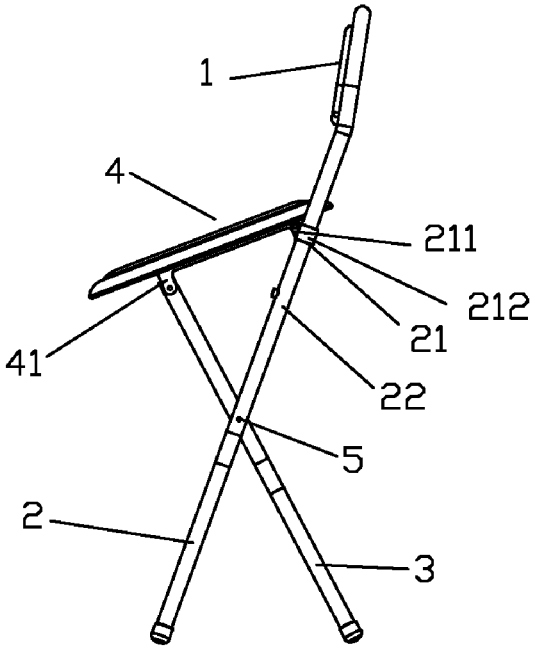
Figure 5:
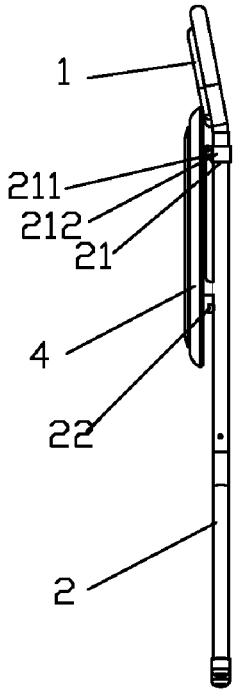

FIGS. 3, 4 and 5 are side views of a foldable chair in a position of unfolded, between folded and unfolded, and folded positions, respectively, according to the present invention. FIG. 3 is a side view of a foldable chair in an unfolded position, the whole structure of the invention clearly shown as also shown in FIG. 1. At this state, front legs 2 and rear legs 3 cross each other at a largest angle; connecting sleeve 21 is stopped by protrusion 22 and cannot be slid downwardly; seat 4 is formed a certain angle with front legs 2 and rear leg 3 via connecting sleeve 21 and connecting piece 41; the chair is in an unfolded position. As shown in FIG. 4, when the chair are folded, connecting sleeve 21 is moved upwardly from protrusion 22, as well as seat 4; the angles between seat 4 with front legs 2 and rear leg 3 are changing; seat 4 is folded and rear legs 3 get close to the front legs 2 gradually, and seat 4 gets close to backrest 1 also. During this process, the angle between front legs 2 and rear legs 3 becomes smaller. In FIG. 5, the chair is in a folded position. Herein, front legs 2 and rear legs 3 have been closed to each other completely, and seat 4 closed to front legs 2 and rear legs 3 completely also; the distance between connecting sleeve 21 and protrusion 22 is the longest. The folded chair mostly saves the engaged space, and is convenient to be arranged and stored.

Figure 6:
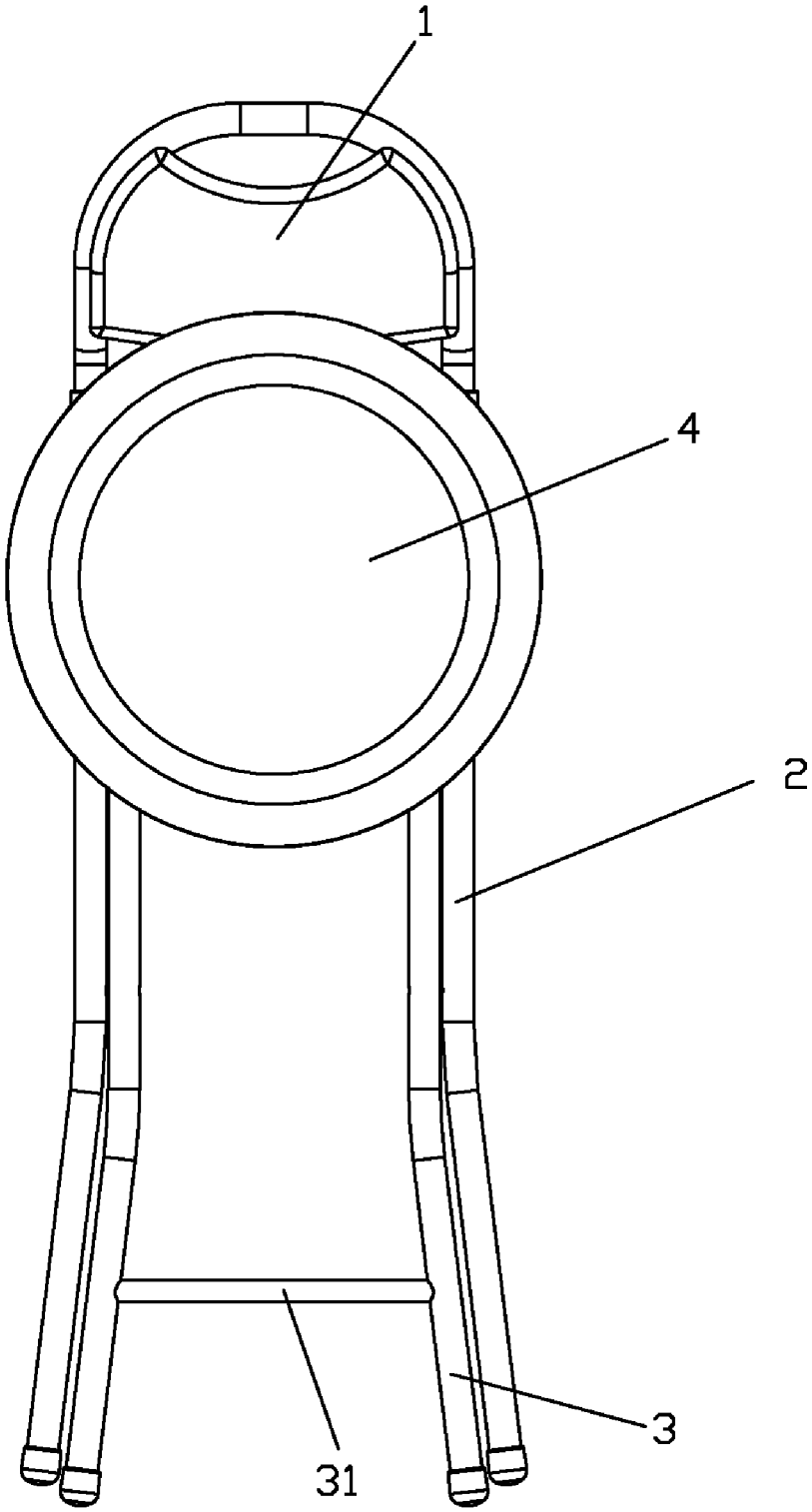
FIG. 6 is a front view of a foldable chair in a folded position, according to the present invention.

Referring to FIG. 6, which is the front view of the folded chair, rear legs 3 are closed to front legs 2 and are arranged between the two front legs 2; seat 4 is close to foreleg 2 and rear leg 3 too; and seat 4 is also in the nearest position to backrest 1.

Figure 7:
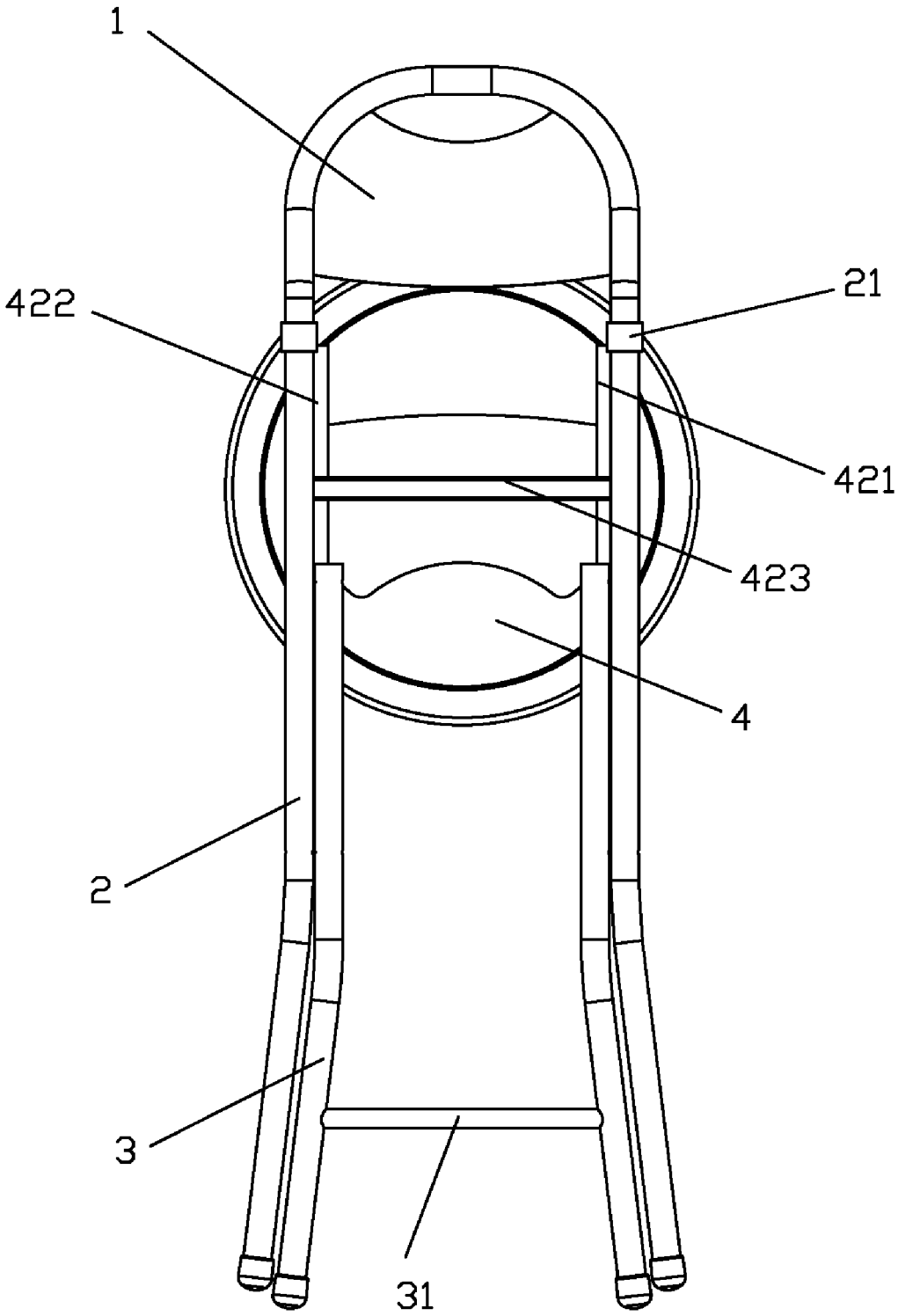
FIG. 7 is a back view of a foldable chair in a folded position, according to the present invention.

Referring to FIG. 7, which is the back view of the folded chair, we can clearly see the "I"-shape reinforcement frame used for adding strength to seat 4. The reinforcement frame includes two lengthwise reinforcement ribs 421, 422 and one transverse reinforcement rib 423, all of them form a structure of an "I" shape to gain in strength of seat 4. Above mentioned connecting piece 41 can be incorporated with the reinforcement frame.

Moreover, protrusion 22 is connected to the described front legs 2 by welding, riveting or bonding, and also can be incorporated with front legs 2. The shape of the seat 4 of the present invention can be circular, square, rectangle or ellipse.

In summary, the structure of the foldable chair of the present invention is simple and easy to manufactured, and can also save the space engaged by the folded chair furthest. It is convenient to be stored and transported and has many utilities.

Although the invention herein has been described with reference to a particular embodiment, it is to be understood that these embodiments merely illustrate the principles and applications of the present invention. It is therefore to be understood that numerous modifications may be devised without departing from the spirit and scope of the present invention as defined by the appended claims.

What is claimed is:

1. A foldable chair, comprising:

a pair of connecting sleeves, each having a tubular body, and a connecting lock piece attached to said tubular body;

a pair of front legs, each of said front legs having a respective one of the connecting sleeves disposed thereon so that the tubular body fully enwraps the respective front leg and so as to be slidable along the respective front leg, each front leg further having a protrusion to stop the respective connecting sleeve from sliding downward;

a pair of rear legs pivotally connected to said pair of front legs, so that each front leg forms an X-shape with a respective rear leg;

a seat having an I-shaped reinforcement frame disposed on a bottom thereof, and a connecting piece fixed to a bottom of said seat and incorporated with said reinforcement frame, an upper end of the rear legs being rotatably hinged to the seat via the connecting piece, each connecting lock piece of each connecting sleeve being hinged to the seat via a rivet; and a backrest attached to the front legs, wherein the protrusion assists in retaining the seat in an unfolded position.

2. The foldable chair according to claim 1, wherein said backrest is attached hinged with one end of said front legs.

3. The foldable chair according to claim 1, wherein said front legs and rear legs cross with each other and form the X-shape when the chair is in the unfolded position.

4. The foldable chair according to claim 1, wherein said protrusion is a pressure-resisting metal piece.

5. The foldable chair according to claim 4, wherein said protrusion is connected to said front legs by welding, riveting or bonding.

6. The foldable chair according to claim 1, wherein said protrusion is connected to said front legs by welding, riveting or bonding.

7. The foldable chair according to claim 1, wherein a cross bar is disposed between said rear legs.

8. The foldable chair according to claim 1, wherein a shape of said seat is circular.

* * * * *